US005490825A

United States Patent [19]

Wilkinson

[11] Patent Number: 5,490,825

[45] Date of Patent: Feb. 13, 1996

[54] MULTI PURPOSE EXERCISE POLES WITH MANY OPTIONAL ATTACHMENTS

[76] Inventor: William T. Wilkinson, P.O. Box 572, Crownsville, Md. 21032-0572

[21] Appl. No.: 301,069

[22] Filed: Sep. 6, 1994

Related U.S. Application Data

[63] Continuation-in-part of Ser. No. 846,053, Mar. 5, 1992, and Ser. No. 941,304, Sep. 4, 1992.

[51] Int. Cl.[6] ..... A63B 21/06

[52] U.S. Cl. ..... 482/74; 482/51; 482/93; 482/109

[58] Field of Search ..... 482/51, 74, 93, 482/109

[56] References Cited

U.S. PATENT DOCUMENTS

| | | | |
|---|---|---|---|
| 83,228 | 10/1868 | Warne . | |
| 2,275,330 | 3/1942 | Tveten . | |
| 3,371,930 | 5/1968 | Shiga . | |
| 4,062,371 | 12/1977 | Bolen . | |
| 4,218,057 | 8/1980 | Wilson . | |
| 4,351,348 | 9/1982 | Axton . | |
| 4,510,485 | 4/1985 | Tahara . | |
| 4,537,394 | 8/1985 | Golinsky, Jr. | 482/109 |
| 4,571,680 | 2/1986 | Wu . | |
| 4,665,373 | 5/1987 | Hait . | |
| 4,688,788 | 8/1987 | Olufs . | |
| 4,756,524 | 7/1988 | Cooney . | |
| 4,958,386 | 9/1990 | Louis-Jeune . | |
| 5,121,925 | 6/1992 | Blundo | 482/109 |
| 5,149,092 | 9/1992 | Parsons . | |
| 5,207,624 | 5/1993 | Paskovich | 482/109 |

*Primary Examiner*—Lynne A. Reichard
*Attorney, Agent, or Firm*—Connolly & Hutz

[57] ABSTRACT

An exercise device having at least one shaft. The exercise device has at least one off-set, either at the top or at the bottom depending upon the user's needs. It is also possible to attach weights or an electronics package to the exercise device.

29 Claims, 7 Drawing Sheets

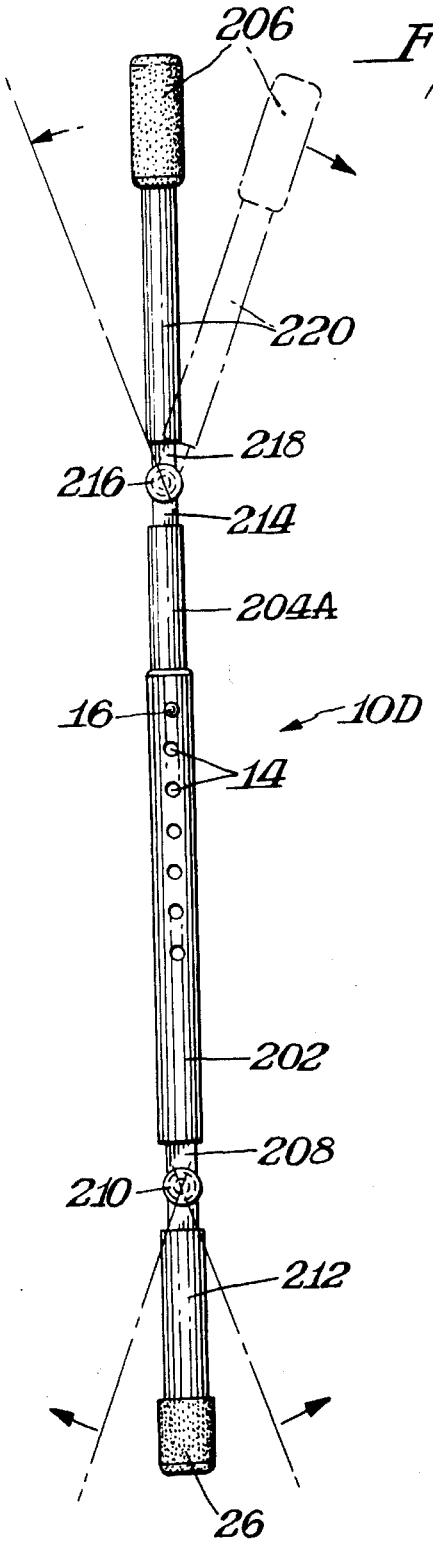
Fig. 23.
Fig. 24.
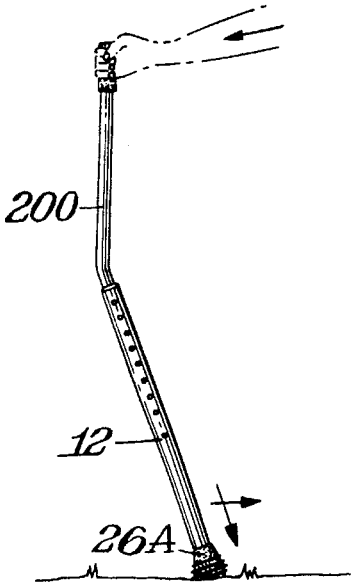
Fig. 25.
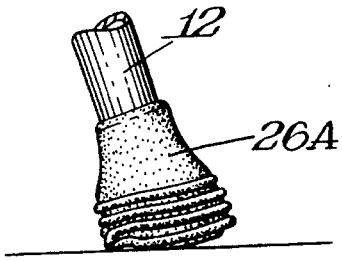
Fig. 26.
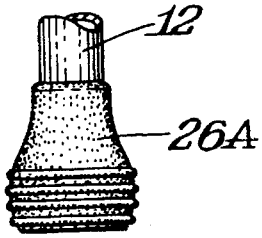

MULTI PURPOSE EXERCISE POLES WITH MANY OPTIONAL ATTACHMENTS

This application is a continuation-in-part application of Ser. No. 07/846,053 filed Mar. 5, 1992 and also is a continuation-in-part application of Ser. No. 07/941,304 filed Sep. 4, 1992.

BACKGROUND OF THE INVENTION

The exercising industry is a growing industry. There is always a need for exercise devices that are economical and can be used in a number of different of exercises. Hand held weights have been found to enhance the benefits of walking or running. However, there is a need for weighted walking poles.

U.S. Pat. No. 4,688,788 issued to Olufs addresses the need for an exercising pole for walking. However, there are some problems with Olufs' pole. For example, the pole is not adjustable. Additionally, the weight is forced inside the hollow core near the grip.

U.S. Pat. No. 4,756,524 issued to Cooney addresses an exercise device, used in pairs to simulate cross-country skiing. The poles are adjustable in height. However, the poles are straight.

SUMMARY OF THE INVENTION

An object of this invention is to provide an adjustable or non-adjustable exercise device in the form of a pole or poles that can be used for exercises such as walking, roller blading, roller skating, jogging, skiing, skate boarding, aerobics, hiking, mountain climbing, fishing, golfing, etc.

Another object of this invention is to have at least one bend in the exercise device to allow the exercise device to be planted in a desired location when the user engages the device.

Another object of this invention is to have a curved sided foot having a flat bottom wherein the curved side can contact the ground.

Another object of this invention is to have weights placed at the bottom of the exercise device.

Another object of this invention is to have weights placed at the top of the exercise device.

Another object of this invention is to have a series of slug weights placed inside the hollow shaft of the exercise device.

Another object of this invention is to have weights placed on the outside of the exercise device.

Another object of this invention is to have an electronics package connected to the handle.

Another object of this invention is to have a method of exercising with at least one exercise device according to this invention.

The exercise device is used primarily for various sports/exercise. The exercise device can be used for other activities by attaching a different type of feet.

In accordance with this invention the exercise device is in the form of a pole which can serve various purposes while engaging in an activity such as:

a) exercise for upper body/arms b) balance c) support, weight bearing reduces leg pressure, rehabilitation (like a cane)

d) protection—to fend off an attacker (animal or human).

BRIEF DESCRIPTION OF THE DRAWINGS

FIG. 23 is a side-elevational of a further alterative embodiment of a device according to this invention having an upper and lower rotatable shaft to adjust the shaft's off-set;

FIG. 24 is a side-elevational view of a further alternative embodiment of a device showing a ground engagement of the pole tip;

FIG. 25 is an enlargement view of the ground contact shown in FIG. 24;

FIG. 26 is an enlarged side-elevational view of the ground contact shown in FIG. 24;

A DETAILED DESCRIPTION OF THIS INVENTION

Figure 1:
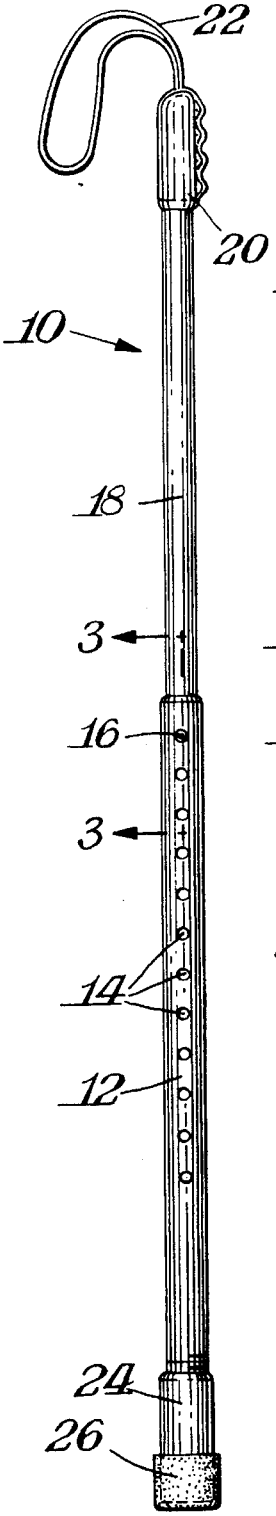
FIG. 1 is a side elevational view of an exercise device in accordance with this invention.

FIG. 1 illustrates an exercise device 10 in accordance with this invention. Device 10 is useful for various types of exercise programs. Advantageously, the device 10 can be used by numerous individuals of different sizes and ages in accordance with different exercise needs. This is possible in part from the dimensional adjustability of the different components forming device 10.

In the general device 10 includes a hollow outer tubular shaft 12, which forms a main component of this device. The hollow tubular shaft 12 can be made from any material such as, but not limited to a suitable metal or plastic. The hollow tubular shaft 12 has a series of aligned holes 14. The bottom of the hollow tubular shaft 12 can be threaded. A telescopic inner shaft 18 having a smaller diameter than the hollow outer tubular shaft 12 fits inside the hollow tubular shaft 12. The telescopic shaft 18 can be solid or hollow and can be made of any material such as but limited to plastic or metal. At the bottom of the telescopic shaft 18 is a spring button lock 16 which selectively fits inside the series of aligned holes 14 to lock the telescopic shaft 18 in a fixed position. A handle 20 fits over the telescopic shaft 18. The handle 20 is contoured and can be made of any material such as rubber, plastic or foam. The handle also has a strap 22 fixed to its top as shown in FIG. 1. The strap can be adjustable. Screw-on weight 24 is attached to the bottom of the hollow tubular shaft 12 or the top of the telescopic shaft 18. Screw-on weight 24 can be of any weight. The preferred weight would range from one half pounds to ten pounds. Attached to the bottom of the screw-on weight 24 is a foot 26. The foot can be a non-slip foot made of any material such as rubber or plastic.

Figure 2:
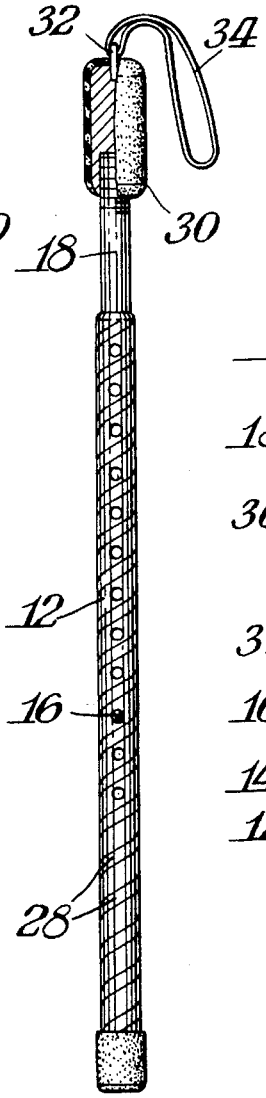
FIG. 2 is a side elevational view partly in section of a further exercise device in accordance with this invention.

FIG. 2 shows the device 10 of FIG. 1 with reflective tape 28 wrapped around the hollow tubular shaft 12 and telescopic shaft 18. In addition the telescopic shaft 18 is preferably threaded at its top. Screw-on weight 24 is be screwed onto the top of the telescopic shaft 18. A foam handle is placed over the top of the screw on weight 24. An eyelet 32 is attached to the screw on weight 24. A strap 34 extends through the eyelet 32. The strap 34 can be adjustable or fixed. A foot 26 is placed at the end of the hollow tubular shaft 12.

Figure 3:
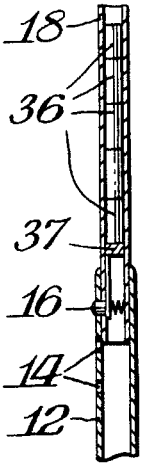
FIG. 3 is a cross-sectional view taken along the line 3—3 of FIG. 1.

FIG. 3 shows another embodiment of this invention. Small weight slugs 36 are lowered into the telescopic shaft 18. The telescopic shaft 18 is partly hollow with a stop 37 at its bottom. The small weights 36 have a smaller diameter than the shaft 18 and are dropped into the shaft 18 and stop at the bottom of the shaft. The user could put as many weights in as desired to get the results intended. Alternatively a material such as a liquid or sand may be poured into the telescopic shaft 18 to act as a weight.

Figure 4:
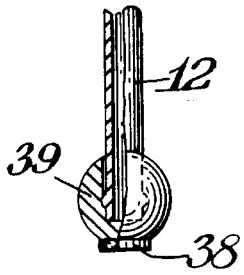
FIG. 4 is a fragmental cross-sectional view of an alternate weight attachment to the exercise device shown in FIG. 1.

FIG. 4 is a fragmental cross-sectional view of the alternate weight attachment. FIG. 4 shows a snap-on ball weight 39 that is snapped on to the bottom of the hollow tubular shaft 12. The snap-on ball weight 39 can come in different sizes and different weights depending on the desired weight by the user. At the bottom of the snap-on ball weight 39 is a no slip pad 38.

Figure 5:
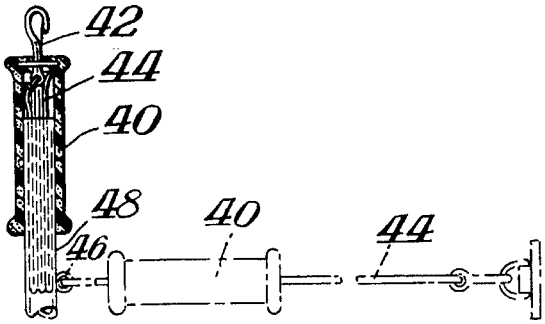
FIG. 5 is a fragmental cross-sectional view of a handle and upper shaft having resistance cords stored in the handle and shaft.

FIG. 5 shows a fragmental cross-sectional view of a handle 40 and telescopic shaft 18 having resistance cords 44 stored in the handle and shaft. In this embodiment the telescopic shaft 18 is hollow as shown in FIG. 5. The handle 40 fits over the telescopic shaft 18. A snap fastener 42 would fit through the handle 40 and inside the telescopic shaft 18. Resistance cords 44 would be stored inside the shaft 18 and fit on the end of the snap fastener 42. An eyelet 46 is be attached to the telescopic shaft 18, as shown in FIG. 5. As shown in phantom the handle 40 can be removed from the telescopic shaft 18 and the snap fastener 42 can be attached to the eyelet 46 on shaft 18. The resistance cords 44 are fastened at one end to the snap fastener 42 inside the handle 40 as can be seen in FIG. 5. The other end of the resistance cords then can be attached to anything else such as a snap, belt, etc.

Elastic resistance means could also be attached to the poles to make moving them more difficult and thus generate more exercise. The cords could be anchored anywhere on the body, but preferably at the waist.

Figure 6:
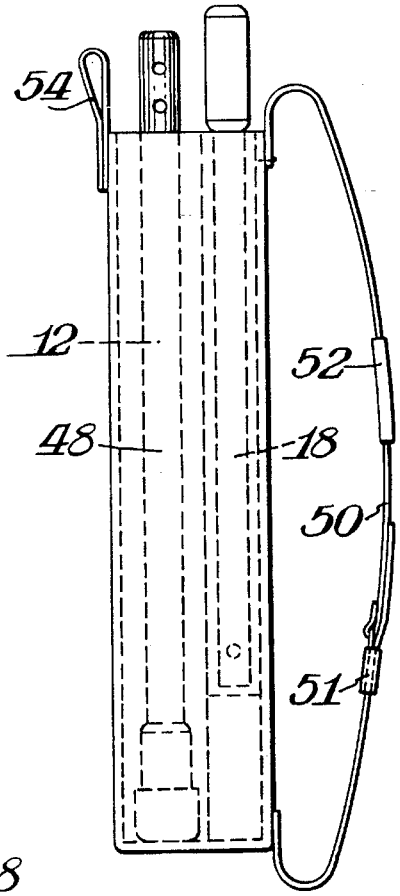
FIG. 6 is an elevational view of a storage case with collapsed shaft sections stored therein.

FIG. 6 shows an elevational view of a storage case with the tubular shaft 12 disconnected from the telescopic shaft 18. The two disconnected shafts are put inside the storage case 48. It would also be possible to fully telescope the shaft 18 inside the tubular shaft 12 for storage purposes. Attached to this storage case 48 is an adjustable strap 50. The adjustable strap 50 is adjusted by sliding the strap through the sleeve 51 and adjusting the strap 50. The adjustable strap 50 can have a shoulder pad on it 52. There can be an optional loop 54 attached to the top of the storage case 48 as seen in FIG. 6 for attachment to a belt.

Figure 7:
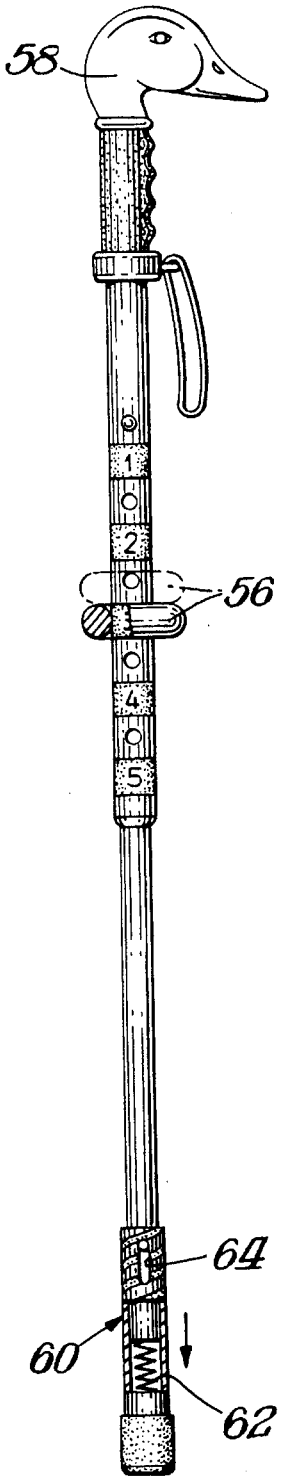
FIG. 7 is a side-elevational view of a further embodiment of an exercise device in accordance with this invention.

FIG. 7 shows a side-elevational view of a further embodiment of a walking stick. In this embodiment outer shaft 12 is shown to be at the top although this aspect of the invention could be practiced with telescopic shaft 18 at the top. Donut weights 56 are frictionally attached to the top shaft 12. The shaft 12 can have a number of colored weight placements as can be seen in FIG. 7. An ornamental knob or handle 58 is attached to the outer shaft 12. A shock absorber spring tip 60 attached to the bottom of the telescopic shaft 18. The shock absorber tip 60 would have a spring biasing means 62 inside the tip. This would allow the walking stick to act as a pogo stick. The shock absorber tip 60 has a pin in slot 64 as shown in FIG. 7. The pin can be turned to engage this spring biasing means 62. A no slip foot 26 is attached at the bottom of the shock absorber tip 60.

The spring biasing means 62 can also be introduced in the various forms of this invention to give the shafts a "pogo stick" or bounces type action to relieve shock and provide a different exercise rhythm. This can be done by placing a spring at the top of the bottom shaft in a shaft attachment stick as shown in FIG. 7. The spring pin on the top of the bottom shaft can be rotated 180° to fall into a slot opposite the adjustment holes on the top shaft. The bottom section can then slide or give, the length of this slot. The spring is anchored to the top shaft (fixed in position) by a pin at the top that engages holes in the top shaft. Thus when weight is put on the exercise device, the bottom shaft moves upwards and compresses the resistance spring for the desired effect.

Tension can be varied by having a) different size/length springs, and b) having a series of vertical adjustment holes to engage the spring pin at different levels.

Figure 8:
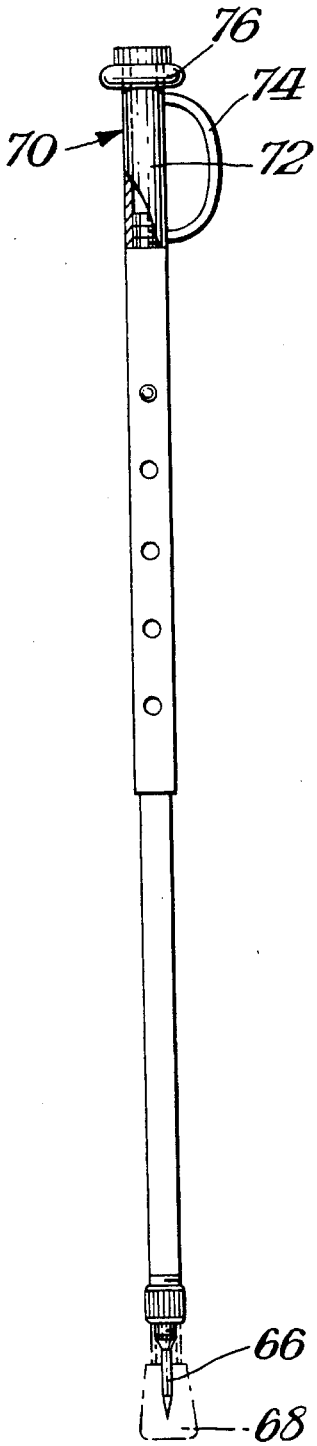
FIG. 8 is a side-elevational view of a still further embodiment of an exercise device according to this invention.

FIG. 8 shows a side-elevational view of another embodiment of a walking shaft. A screw-on hiking pick/trash spear 66 is attached such as by being screwed to the bottom of the lower shaft 18 where the shafts are arranged as in FIGS. 1–2 outer shaft 12 is the lower shaft. A screw-on tip 68 can be screwed on to the bottom of the hiking pick thereby covering up the point. A dumb bell weight 70 is attached to the top of the outer shaft 12. A dumb bell weight 70 consists of a dumb bell grip 72, a dumb bell strap 74 and a dumb bell weight 76. The dumb bell grip 72 is attached to the shaft 12. The dumb bell strap 74 is attached to the dumb bell grip 72. The dumb bell weights sit above the dumb bell strap and are attached to the very top of the shaft 12. Additional weights can be placed on the shaft 12.

Figure 9:
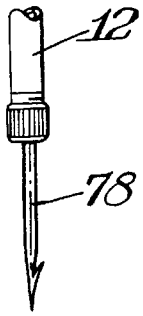
FIG. 9 is a side-elevational view of fishing gaff attachment to the lower section of an exercise device according to this invention.
Figure 10:
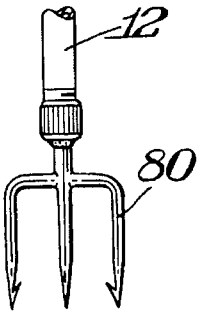
FIG. 10 is a side-elevational view of frogging gaff attachment to the lower section of an exercise device according to this invention.
Figure 11:
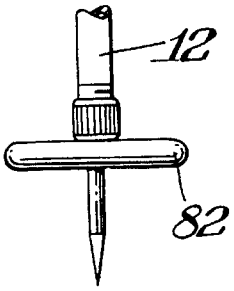
FIG. 11 is a side-elevational view of a ski pole attachment to the lower section of an exercise device according to this invention.

FIGS. 9 through 11 show different attachments that can be placed at the bottom of the lower shaft. FIG. 9 shows a fishing gaff 78. FIG. 10 shows a frogging gaff attachment 80. FIG. 11 shows a ski pole attachment 82. It is also possible attach different golf club heads to the bottom of the lower shaft.

Figure 12:
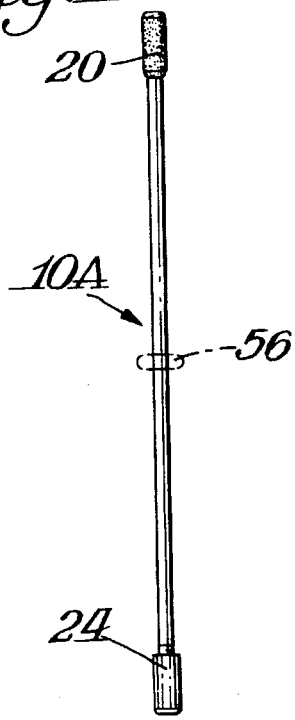
FIG. 12 is a side-elevational view of a still further embodiment of an exercise device in accordance with this invention.

FIG. 12 shows the exercise device 10A. The exercise device 10A consists of a shaft 11 which can be solid or hollow. The shaft 11 is not adjustable. The shaft 11 can be made from any material and ranges from a height of about 24 inches to about 72 inches, and preferably from about 36 inches to about 60 inches. A screw-on weight 24 is attached to the bottom of the shaft 11. A handle 20 is attached to the top of the shaft 11. A donut weight 56 is shown in phantom attached to the middle of the shaft 11.

Figure 13:
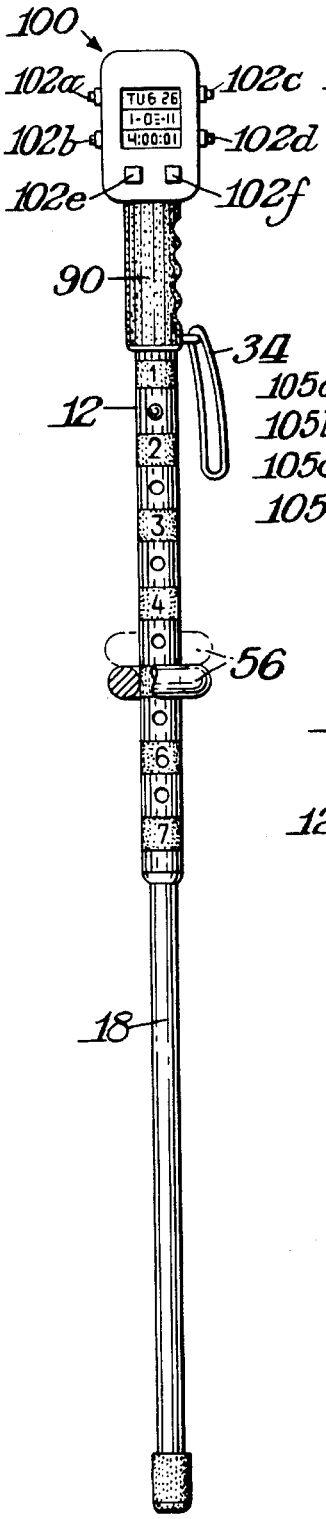
FIG. 13 is a side-elevational view of a still further embodiment of an exercise device in accordance with this invention.

FIG. 13 shows a side-elevational view of a further embodiment of an exercise device in accordance with this invention. In this embodiment outer shaft 12 is shown to be at the top although this aspect of the invention could be practiced with telescopic shaft 18 at the top. Donut weights 56 are frictionally attached to the top shaft 12. The shaft 12 can have a number of colored weight placements as can be seen in FIG. 13. A handle 90 is attached to the outer shaft 12. An electronic package 100 is attached to the top of the handle 90. As later described the electronics package 100 can take various forms. A suitable electronics package would display the time, the day and date, the distance traveled, a pulse meter, also have a stop-watch, an alarm, an hour beeper and a light. The electronics package 100 would have a series of buttons 102 (*a–f*) which would activate the various functions as can be seen in FIG. 13. A mechanism for the electronics package would be the same as found on sports watches. In addition, a beeper 102*g* can be connected to the pole on the handle 90. The user could press the beeper 102*g* in the grip of the handle 90 which could engage the beeper. The beeper 102*g* can omit a high pitched sound which could be similar to that of a dog whistle, which would effectively chase away animals, such as dogs, from the user.

Figure 14:
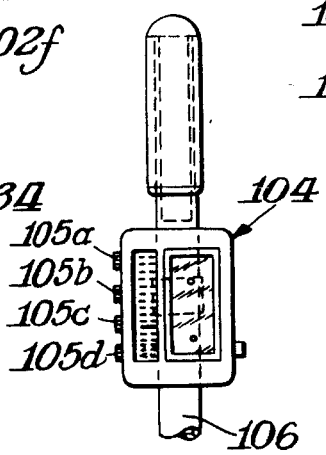
FIG. 14 is a side-elevational view of a cassette radio attachment to the upper section of the exercise device according to this invention.

FIG. 14 shows another type of electronics package 104 that can be used with this invention. This electronic package would include an am/fm cassette radio 104 that can be attached to the upper shaft of the walking device. There would be a series of buttons/dials 105(*a–d*) that would operate the various functions. For the cassette there would be fast forward, reverse, play, record, and volume control. For the radio the functions would include channel selection, am or fm selection and volume control. This can be mounted by brackets on the outside of the tape player to the upper shaft 106. In addition a compact disc player could be mounted the same way to the upper shaft 106.

Figure 15:
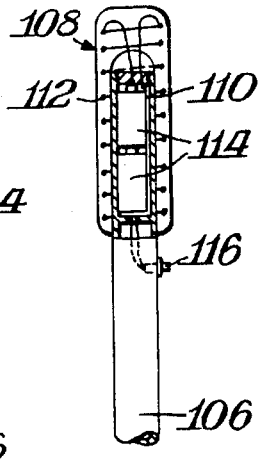
FIG. 15 is a side-elevational view of a heating attachment to the upper section of the exercise device according to this invention.

FIG. 15 shows a heating mechanism 108 attached to the outside of the upper shaft 106. The heating mechanism 108 would consist of heating coils 110 attached to the upper shaft 106 and to the inside of the handle 112. Batteries 114 would be placed in the upper shaft 106. The handle 112 would be placed over the heating coils and thereby when the user grasp the handle, the user can turn a switch 116 and activate the heating coils thereby causing heat to be generated to keep the user's hands warm.

Figure 16:
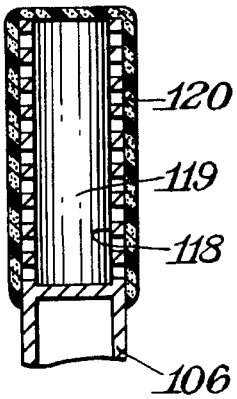
FIG. 16 is a side-elevational view of a cooling attachment to the upper section of the exercise device according to this invention.

FIG. 16 shows a side-elevational view of a further embodiment of a walking device. The upper shaft 106 can be hollow and have a storage compartment 118. Cold packs or chemicals 119 can be placed inside the storage compartment 118. Over the shaft 106 can be placed a handle 120 perforations around the perimeter made of high porosity foam cover to keep the user's hands cool during the summer time.

Figure 17:
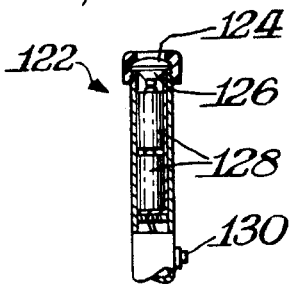
FIG. 17 is a side-elevational view of a light attachment to the upper section of the exercise device according to this invention.

FIG. 17 shows a side-elevational view of a further embodiment of the walking stick. As shown therein a flashlight 122 consisting of a lens 124, a bulb and reflector 126 and a set of batteries 128 is mounted to the walking stick. These attachments can be placed at the top or at the bottom of the walking stick. FIG. 17 shows the flashlight at the bottom of the walking stick. The flashlight would be activated by turning on the switch 130. The flashlight switch could be set up to have a blinking capability. The flashlight on the walking stick would allow the user to use the stick in the night.

Figure 18:
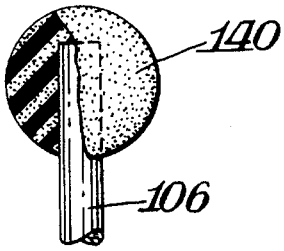
FIG. 18 is a side-elevational view of a hand grip attached to the exercise device according to this invention.

FIG. 18 shows a side-elevational view of a further embodiment of the walking stick. As shown therein is a handle 140 attached to the shaft 106. The handle 140 would be made of a resilient material such as but not limited to rubber. The handle shown is spherical in shape but it could other shapes. The user would be able to perform hand strengthening exercises by griping the handle tightly and releasing and then regripping.

Figure 19A:
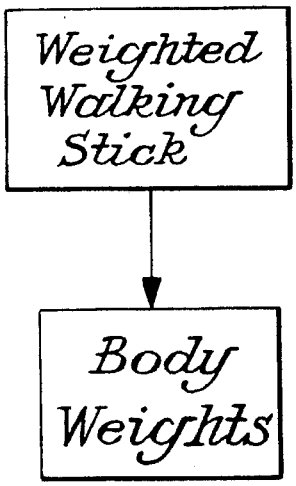
FIGS. 19*a* and 19*b* are flow charts of a process of using an exercise device according to this invention.
Figure 19B:
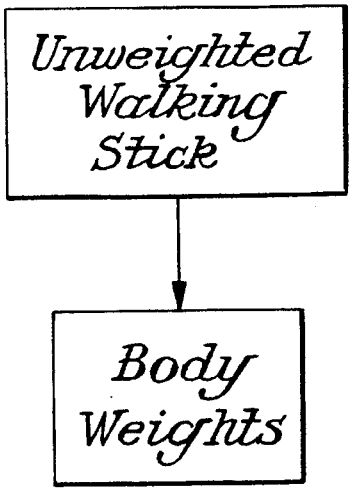

FIG. 19 shows a flow diagram of different possible ways of using the walking stick. FIG. 19*a* shows that the walking stick may be weighted and the person may also use body weights such as hand, ankle, glove, vest, shoe or belt weights. The person exercising would engage in a routine with the weighted walking stick and body weights. FIG. 19*b* shows an unweighted walking stick and the person would use body weights during the users exercise routine. The possible way to exercise is just using a weighted walking stick.

Figure 20:
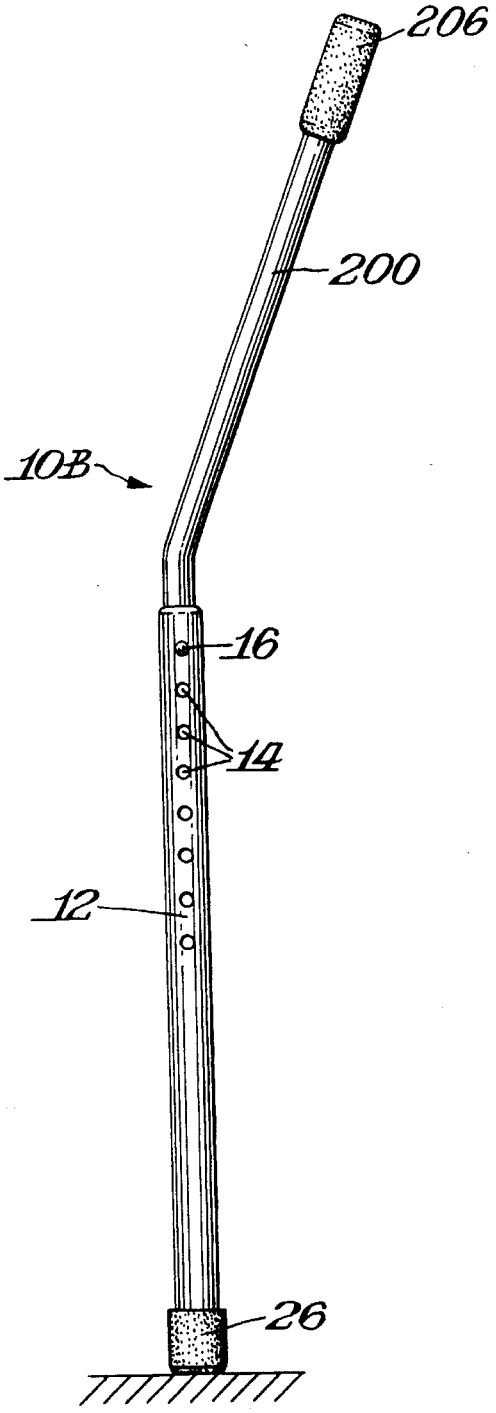
FIG. 20 is a side-elevational view of a device according to this invention having an off-set shaft.

FIG. 20 shows a side-elevational view of another embodiment of an exercise device having an off-set shaft according to this invention. The exercise device 10B includes a hollow outer tubular shaft 12, which forms the main component of this device. The hollow tubular shaft 12 is described in FIG. 1. The hollow tubular shaft 12 can have series of aligned holes 14. A non-slip foot 26 can be on the bottom of the tubular shaft 12. It is also possible that the non-slip foot 26 can be angled such that when the user places the pole down on the ground the pole forms about a 90° angle with the ground. Stated another way, the pole would be perpendicular to the ground. The bottom of the foot could be angled preferably from about 15° to 180° so that when the user places the device at an angle, the device could be about perpendicular to the ground. The telescope shaft 200 can be solid or hollow, can be made of any material such as, but not limited to plastic or metal. The telescopic shaft 200 would have at least one off-set in it forming an angle greater than 90° and less than 270° and preferably from about 140° to about 225°. If the shaft did not have the off-set, then the angle would be 180°. At the top of the shaft 200, could be handle 206 made of any resilient material such as, but not limited to foam. It is also possible that the pole is made of one shaft (see FIG. 12) having at least one bend in the shaft.

Figure 21:
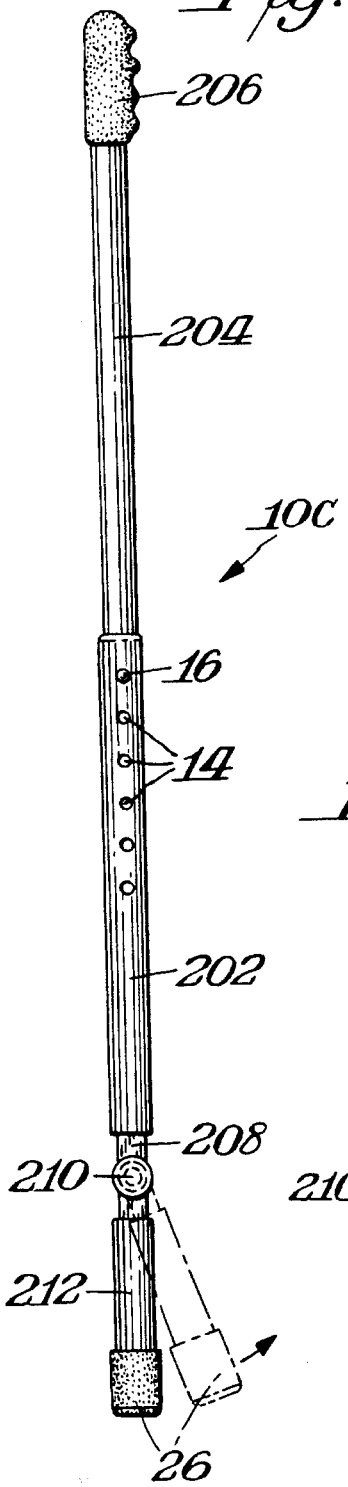
FIG. 21 is a side-elevational view of an alternate embodiment of a device according to this invention having a rotatable shaft to adjust the shaft's off-set.
Figure 22:
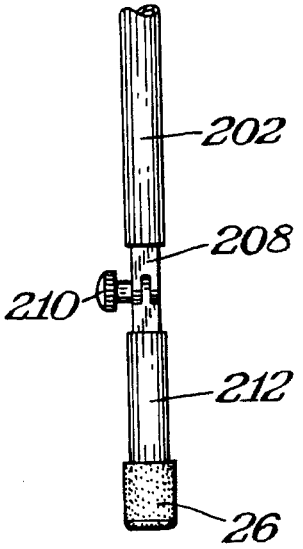
FIG. 22 is a front-elevational view of FIG. 21.

FIG. 21 shows a side-elevational view of a further embodiment of an exercise device having a rotatable shaft to adjust the shaft's off-set. The general device 10C includes a hollow outer tubular shaft 202 which forms the main component of this device. The hollow tubular shaft 202 can be made of any material such as, but not limited to a suitable metal or plastic. The hollow tubular shaft 202 can have a series of aligned holes 14. A telescopic inner shaft 204 having a smaller diameter than the outer tubular shaft 202 could fit inside the hollow tubular shaft 202. The telescopic shaft 204 can be solid or hollow and can be made of any material such as, but not limited to plastic or metal. At the bottom of the telescopic shaft 204, is an adjustable means 16 such as, but not limited to, a spring button lock which selectively fits inside of the aligned holes 14 to lock the telescopic shaft 204 into a fixed position. A handle 206 could fit over the telescopic shaft 204. The handle 206 can be contoured and can be made of any material such as, but not limited to plastic, rubber or foam. The handle 206 can also have a strap fixed to it as is shown in FIG. 1. This strap can be adjustable. Screw-on weights can be attached to the top of the handle as shown in FIG. 1. The tubular shaft 202 can have a smaller solid shaft 208 connected to the bottom of the hollow tubular shaft 202. An adjusting means 210 could be connected to the shaft 208. A lower foot or leg 212 could be connected to the shaft 208 and to the adjusting means 210. The adjusting means 210 can be, but is not limited to a lock-knob or tongue and groove pivot joint as shown in FIG. 22. The knob can be loosened to move the lower leg 212 to the desired angle, then the knob can be turned the opposite direction to tightened the lower leg 212 so the leg could be positioned to the desired angle. On the bottom of the lower leg 2 12 could be a non-slip contact foot 26.

FIG. 22 shows the adjusting means 210 from FIG. 21. The adjusting means 210 can be a tongue and groove pivot joint. The lock can be tightened to adjust the angle of the off-set shaft to the desired location. The angle can be changed depending on which user uses it or the terrain that the user is going up. On a steep hill, the angle could be adjusted for shorter strides when the user goes up hill and adjusted differently for the longer strides when the user goes down hill. The angle could be adjusted so that when the pole is placed down and touches the ground, the pole is actually in a perpendicular position with respect to the ground.

FIG. 23 shows a side elevational view of a further alternative embodiment of an exercise device according to this invention having an upper and lower rotatable shaft to adjust the shafts off-set. As discussed above in FIG. 21, the exercise device can have at least one adjusting means to adjust the off-set of the pole as shown in FIG. 21, or can have at least two adjusting mechanisms to change the off-set of the shaft as shown in FIG. 23. FIG. 23 is the same as FIG. 21 except for the additional rotatable upper shaft 220 and shafts 214 and 218, and adjusting mechanism 216. In FIG. 23, the upper and lower shafts 220 and 212 can be off-set as is described in detail in FIGS. 21 and 22. The off-set can be changed by the adjusting means 210 and 216. This could allow the user to lock the shaft into the desired position. The lock knob shown in 210 and 216 can be turned to lock the shafts 212 and 220 into the desired position. It is also possible to have more than two offsets or more than two adjusting means such as 210 and 216. All of the above embodiments can include an electronics package or weights as described in FIGS. 1 through 19 above.

FIG. 24 shows a side-elevational view of a further embodiment of a walking device. The walking device shown in FIG. 24 is very similar to that which was described in FIG. 20 above. This walking device has a different non-slip foot 26A. The foot 26A can be made of a resilient material such as, but not limited to, rubber.

FIG. 25 shows an enlarged view of the foot 26A making contact with the ground. The foot 26A is shown with annular rings and ground enhancing ribs. The annular rings are compressed when the foot 26A is pushed into contact with the ground, and grips the ground preventing slippage of the pole.

FIG. 26 shows the foot 26A in the non-engaged upright position when the foot 26A is not being engaged into the ground. The foot 26A has a concave surface at the top of the foot closest to the pole. Annular rings go from around the middle of the surface to the bottom of the surface that hits the ground. The ground surface at the bottom of the tip may be flat or may consist of smaller diameter annular rings.

Figure 27:
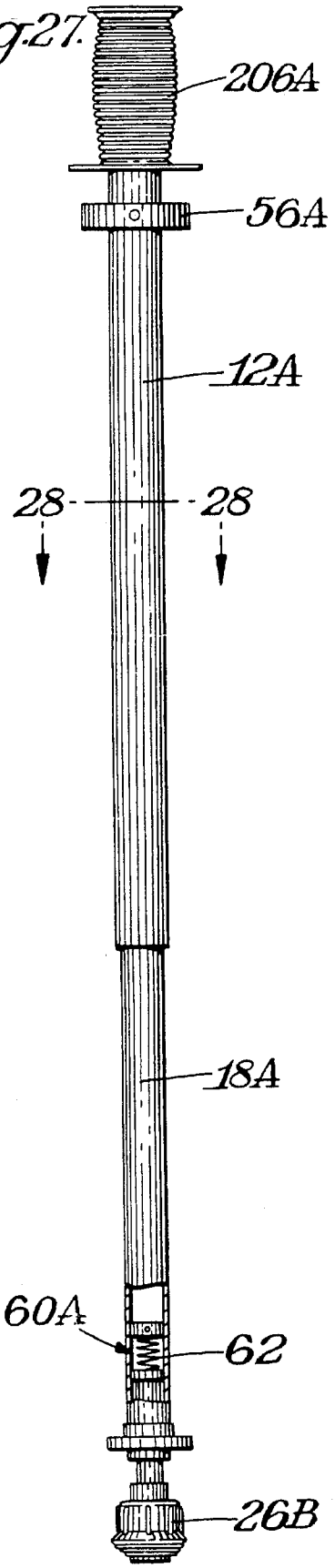
FIG. 27 is a side-elevational view of a still further embodiment of a walking stick.

FIG. 27 shows another embodiment according to this invention. The device can have an outer shaft 12A. The outer shaft 12A can be hollow. An inner shaft 18A having a smaller diameter than the outer shaft 12A can fit inside the outer shaft 12A. The locking mechanism of this walking device may be that as described in FIG. 13 above or that as described in FIG. 28 below. A weight 56A can be attached to the outer shaft 12A. The weight 56A may be attached and locked into position by tightening the screws into place as shown in FIG. 27. Also shown in FIG. 27 is a squeezable handle 206A. A user can get a workout by squeezing the resilient handle 206A. The handle 206A can be in a shape that conforms to the hand where the center of the handle cart be wider than the top and bottom ends as shown in FIG. 27. The user could squeeze the handle, thereby exercising the hands and the wrists while using the exercise device. At the bottom of the pole can be a spring loaded power tip 60A. The spring loaded power tip 60A could have a spring 62 inside said tip and a non-slip foot 26B connected to the spring loaded tip 60A. When the non-slip foot 26B makes contact with the ground, the tip 60A would spring back and give resistance and allow the pole to make better contact with the ground.

Figure 28:
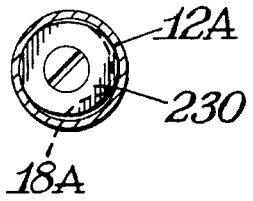
FIG. 28 is a cross-sectional plane view taken along line 28—28 of FIG. 27.

FIG. 28 shows a turn and twist locking mechanism. The inner shaft 18A can be turned clock-wise and locked into place inside outer shaft 12A. To loosen or adjust the shaft, the inside shaft 18A is turned the opposite direction until it becomes loose, pulled down to the desired height and then locked back into place.

The exercise device can be used for other body exercises when not walking, running or other motion exercises—i.e. for exercise at rest. This can be done by the inclusion of one or more elastic cords that can be clipped/snapped onto the pole at various positions. Various resistance exercises can then be done such as:

1) arm curls
2) leg squats
3) shoulder shrugs
4) bench presses
5) rowing
6) leg presses
7) arm presses The cords can be stored easily, such as inside hollow handles that screw on the top of the shaft. The ends cart attach to the shaft by loops or clips.

Weights can be added or subtracted in a number of ways to the poles, for a progressive exercise program, and more or less exercise.

The shaft or shafts can be hollow, as to be able to be filled with cylindrical weight slugs, such as are used in weighted vests.

Interchangeable weights can be screwed or snapped on to vary weight. Forms of such weights are ball feet, or cylindrical weighted bottoms. These variable weight pieces could be of any size or shape.

Although screw threads are illustrated as the preferred means of attachment, other attaching means may be used such as friction connection or interlocking parts.

It is to be understood that various features shown for specific embodiments can be used with other embodiments. Similarly the outer shaft 12 can be disposed at the top shaft or as the lower shaft in the various embodiments.

The basic components of the pole are:

a) One or more shaft sections—if there is more than one shaft section, these can fit together by screwing or pressure fit. The shaft section would have at least one bend or at least one off-set in the section. One section can telescope into the other, for easy carrying or storage. A spring pin and hole telescoping mechanism can be used to adjust the length of the pole for different activities, and/or different size people. The pole can be non-adjustable (if there are one or more shafts in particular, if there is one shaft). The pole can also be adjustable in length—the length of the pole(s) can be varied by a variety of mechanisms such as, but not limited to:

a) telescoping, spring pin and hole b) telescoping, screw/clamp ring collar c) two or more sections that screw or pressure fit together d) one or more sections joined by a folding hinge.

The purpose of adjustable length is for different sports, size people, compactness for carrying or storage. Again, the pole can aim be a single non-adjustable shaft. It is also possible that the poles have the following additional features:

1) Adjustable Weight (Amount)—The weight of the poles can be varied by adding weight in a number of ways:

a) placing weights inside hollow poles or handles;

b) placing weights on the poles or handles. Weights can be screwed, clipped, clamped, hooked or pinned onto the shafts/handles. Magnetic weights can be placed on the shafts. Doughnut-type weights can be slid onto the shaft and "stacked";

c) weights can be screwed or pressure fitted onto the tops or bottoms of the shaft and handles. Screw-off feet of different sizes can be used to vary the weight of the shafts.

Varying the amount of weight allows the user to engage in a progressive exercise program and adjust the "feel" of the poles.

The weights can also be designed to be moveable up and down the shaft, instead of only being in one fixed position. This produces a "metronome" effect that permits the user to vary the feel, swing rate, and wrist/arm torque required to move the poles. Again, weighs can be positioned using a variety of attachment means including screw clamping, wrapping with a velcro strap, or sliding up and down in a slot along the shaft.

One excellent way to adjust the position of the weight, is to have doughnut-shaped weights that slide up and down the pole. The weights are coated with a soft substance such as rubber or vinyl to prevent scratching the poles. The diameter of the "doughnut" holes is about the same as the outside diameter of the poles, so that the weights will "pressure fit" around the pole, so much that they will not slip when being used, but that with force they can be moved up and down for adjustment purposes.

The weights can range from half a pound increments up to 15 pounds and preferably from 1 pound up to 5 pound increments.

To aid the user in balancing the weight equally on each pole, colored/lettered or numbered hash marks are placed on each pole for reference. These also serve to identify the level of placement for the degree of exercise.

2) Handle or padded grip—the grip can have a detachable decorative knob at the top. The grip also has molded plastic guards above and below the hand to prevent slippage. A wrist or hand strap is attached to the handle to allow for a relaxed grip, and to prevent poles from being dropped.

3) Permanent or detachable foot—the foot has a non-slip rubber base for traction. A set of interchangeable detachable feet can create a multipurpose pole(s). In addition in another embodiment the foot can be a curved sided foot having a flat bottom and curved side which can contact the ground. The base or the edge side contacts the ground. Alternatively the edge of the foot where the side joins the bottom can be either pointed or preferably, curved. When the pole and the foot are tilted at an angle less than 90° the preferred embodiment of the foot is that the sides of the foot are convexly shaped or outwardly curved to promote contact with the ground. Additionally the curve side surface of the foot can have nubs, grooves, or other non-slip formations on the surface to promote traction. Different feet attachment for: walking, trash pickup, spear fishing, a pick for rough terrain or mountain climbing, golfing, etc.

4) Wrist Strap—A wrist strap is attached to the upper part of the shaft or handle, that allows and open or relaxed grip on the handle. In addition, it acts as a guard against losing a pole by dropping it.

5) Safety bands/colors—Bright fluorescent colors/bands are used on the poles for day and night safety.

6) Dumbbell grip—The handles can be a dumbbell/hand weight that converts to a grip by one or both ends screwing off, and one end screwing onto the top of the shaft. Thus the dumbbell handle can convert to a pole/grip handle, and/or a weighted handle and a back strap can serve as a grip strap.

7) Adjustable, padded carry strap, sling or case—Means to carry the poles when not in use is aim part of the invention. The poles can be carried in one hand, off the waist, on the shoulder, or slung across the back. An adjustable length, padded strap with velcro ties on each end, is a handy way to carry the poles when not in use, or hang them up for storage at home or in a gym. Another good way is a sheath, with an adjustable, padded carry strap.

8) Electronics package—which can include, for example, a means for instantly finding out the day/date, time, distance traveled (kilometers or miles), a pulse meter, a stopwatch, an alarm, hourly beeper, countdown timer and a light (similar to a sport watch); am/fm radio; am/fm cassette player; a beeper; a compact disc player or any other battery operated device including a small TV set.

9) Temperature regulated handle—which can include heater coils inside the handle which is activated by a switch. The heated handle would be advantageous for winter time use. The handle aim can be hollow in which cold packs can be stored inside the handle. This would be advantageous for summer time use.

10) Flashlight—which can be stored in the tip of the walking stick. The flashlight would consist of batteries, a bulb and reflector, and a lens. The flashlight could emit either a continuous beam or a blinking beam.

11) Resilient Handgrip Handle—which would allow the user to strengthen the users hands while using the walking sticks of this invention.

12) Beeper built into the handle—which would allow the user to press the button in the grip of the handle engaging (turning the beeper on). The beeper can omit a high pitched sound which could chase animals such as dogs away from the user.

While there is shown and described herein certain specific structure embodying the invention, it will be manifest to those skilled in the art that various modifications and rearrangements of the parts maybe made without departing from the spirit and scope of the underlying inventive concept and that the same is not limited to the particular forms herein shown and described.

I claim:

1. A pole device for the aiding of forward movement comprising:

(a) at least one tubular shaft which forms a pole having a top and bottom end and having at least one bend or adjustable offset in said shaft, (b) means for exercising a user's arms during the course of forward movement of the user's legs, during relative movement of the user's arms with respect to the user's body while the user grips the top end of the pole by the user's hand during the course of forward movement of the user's legs, (c) the bottom end of said pole being of sufficient length for the user to grip said top end of said pole during the course of forward movement while said bottom end of said pole touches a ground surface, and (d) wherein the touching of said bottom end with the ground surface comprises a push off means to assist the user in moving forward.

2. The device as claimed in claim 1, further comprising a weight which is attached to said pole.

3. The device as claimed in claim 2, wherein said weight is attached to the top of said pole.

4. The device as claimed in claim 2, wherein said weight is attached to the middle of said pole.

5. The device as claimed in claim 4, wherein the weight is a donut shaped weight.

6. The device as claimed in claim 1, further comprising a removable tip at the bottom of said pole.

7. The device as claimed in claim 6, wherein the removable tip is selected from the group consisting of a ski pole, hiking pick, shock absorber tip, ball weight frogging gaff, fishing gaff and golf club attachment.

8. The device as claimed in claim 1, further comprising an electronics package which comprises a clock.

9. The device as claimed in claim 8, wherein the electronics package further comprises at least one of the following components a stopwatch, a pedometer, a pulse meter, an hour chime, an alarm, a light, a day/date mechanism and a beeper which can omit a high pitch sound.

10. The device as claimed in claim 1, further comprising an electronics package which is selected from the group consisting of am/fm radio, am/fm cassette, cassette, and compact disc player.

11. The device as claimed in claim 1, further comprising a handle mounted to the top of said pole.

12. The device as claimed in claim 11, further comprising an adjustable strap attached to said handle.

13. The device as claimed in claim 12, further comprising resistance cords stored in said handle.

14. The device as claimed in claim 11, wherein said handle is made from a resilient material.

15. The device as claimed in claim 1, further comprising a non-slip foot, attached to the bottom of said pole.

16. The device as claimed in claim 2, further comprising a grip and said weight being at the top of said pole and inside said grip.

17. The device as claimed in claim 1, further comprising a safety stripe wrapped around said shaft.

18. The device as claimed in claim 1, wherein there are at least two shafts, the first shaft wherein has a smaller diameter than the second shaft and the second shaft is a hollow outer tubular shaft, which fits over the first shaft forming a pole and at least one of said shafts has at least one bend or off-setting means.

19. The device as claimed in claim 18, wherein said outer tubular shaft and said inner shaft are detachably mounted and are capable of being stored as separate members in a carrying case.

20. The device as claimed in claim 1, further comprising a carrying case and said pole is fully collapsed and stored in said carrying case.

21. The device as claimed in claim 18, further comprising at least one adjusting means attached to either the first shaft or second shaft or both that adjusts the angle of said shaft whereby the pole is capable of being bent in several different possible positions.

22. The device as claimed in claim 21, further comprising a non-slip foot attached to the bottom of said pole wherein said foot is angled at the bottom of said foot which would enable a user to place the pole at an angle on the ground and have the pole be perpendicular to the ground.

23. A method of exercising comprising swinging the device as claimed in claim 1, in a back and forth direction with each hand.

24. A method of exercising comprising swinging the device as claimed in claim 1, in a back and forth direction with each hand and having the user wear body weights.

25. The device as claimed in claim 1, wherein said exercise device is collapsible for easy storage and carrying when not in use.

26. The device as claimed in claim 1, wherein said exercise device is adjustable in length to fit persons of different height.

27. The device as claimed in claim 18, wherein said pole device is adjustable in length so that an individual can vary the length of said pole device so that the user can change the length of his or her stride to facilitate the maximum workout for the length of the said device.

28. An exercise device comprising:

a) a hollow outer tubular shaft, b) an inner tubular shaft wherein said inner tubular shaft has a smaller diameter than said outer tubular shaft, and said inner tubular shaft fits inside said outer tubular shaft, c) at least one bend or adjustable offset in either said outer or inner shaft, d) a twist and lock adjusting and locking means which fits inside the said inner shaft whereby the outer shaft can be turned in the opposite direction of said inner shaft to lock said inner shaft into position, and e) means for exercising a user's arms during the course of forward increment of the user's legs, during relative movement of the user's arms with respect to the user's body while the user grips the top end of the pole by the user's hand during the course of forward movement of the user's legs.

29. A pole device for the aiding of forward movement comprising:

(a) at least one shaft having a bend or an adjustable offset forming a pole, said pole having a top end and a bottom end, (b) a handle attached to said shaft at the top end of the pole, (c) means for exercising a user's arms during the course of forward movement of the user's legs, during relative movement of the user's arms with respect to the user's body while said handle is gripped by the user's hand during the course of forward movement of the user's legs, (d) wherein said handle is attached to a top end of said device and said handle is capable of being gripped by user's hand, said device having a bottom end, said device being of sufficient length for the user to grip said handle during the course of forward movement while said bottom end of said device touches a ground surface, and (e) the touching of said bottom end with the ground surface comprising a push-off means to assist the user in moving forward.

* * * * *